US005397030A

United States Patent [19]

Williams

[11] Patent Number: 5,397,030

[45] Date of Patent: Mar. 14, 1995

[54] TOOTH PASTE DISPENSER

[76] Inventor: Fred G. Williams, Kent Manor Inn, 500 Kent Manor Dr., Stevensville, Md. 21666

[21] Appl. No.: 112,343

[22] Filed: Aug. 27, 1993

[51] Int. Cl.[6] ..... B65D 35/54

[52] U.S. Cl. ..... 222/96; 222/102

[58] Field of Search ..... 222/96, 101, 102

[56] References Cited

U.S. PATENT DOCUMENTS

| | | | |
|---|---|---|---|
| 2,670,876 | 3/1954 | Clouse | 222/102 |
| 3,197,072 | 7/1965 | Dick | 222/102 |
| 4,019,655 | 4/1977 | Moeller | 222/96 |

FOREIGN PATENT DOCUMENTS

| | | | |
|---|---|---|---|
| 602639 | 5/1948 | United Kingdom | 222/102 |
| 2052434 | 1/1981 | United Kingdom | 222/102 |

*Primary Examiner*—Andres Kashnikow
*Assistant Examiner*—Joseph A. Kaufman
*Attorney, Agent, or Firm*—John B. Dickman, III

[57] ABSTRACT

A dispenser for squeezing a collapsible tube including a housing with a reciprocating wall where the wall has a tooth gear for engaging and moving a mechanical follower along a collapsible tube to dispense paste each time the reciprocating wall is reciprocated. A closure is opened and closed with each reciprocation of the reciprocating wall to dispense the paste.

3 Claims, 1 Drawing Sheet

TOOTH PASTE DISPENSER

BACKGROUND OF THE INVENTION

This invention relates to a dispenser for collapsible tubes containing toothpaste, shaving cream, or similar pastes, and in particular, a dispenser for holding a collapsible tube of paste and mechanically dispensing the paste.

Heretofore, there have been several dispensers for collapsible paste tubes. These dispensers have taken many shapes and types of mechanical operations. From the earliest to the more recent patents covering these devices, the similarity between them is in the squeezing of the tube to remove most or all of the paste. To accomplish the squeezing of all of the paste out of a tube, the prior art uses some type of mechanical roller means to travel along the tube. The U.S. Patents to Mirka, U.S. Pat. No. 3,417,902, Forman, U.S. Pat. No. 3,853,243, and Drancourt, U.S. Pat. No. 4,030,636, shows paste dispensers with rollers which travel over a tube to squeeze out paste. The most interesting of these patents in relation to the present invention is the Mirka patent, where the roller is moved by a bar gear with teeth which engage teeth on the roller to move it forward. Other mechanical means for squeezing a tube are disclosed in Glaser, U.S. Pat. No. 1,882,358, and Van Bussel, U.S. Pat. No. 3,915,342, These patents use movable plates to squeeze the tube.

SUMMARY OF THE INVENTION

This invention comprises a paste dispenser which houses a tube of paste and a mechanical follower for squeezing the tube. A slidable sled with a pair of rollers is operated by a reciprocating wall having a tooth gear bar on one side. The slidable sled has a spring biased bar for engaging the tooth gear bar to move the sled over the tube. Each time the movable wall is reciprocated, the slidable sled is moved an incremental amount over the tube. A pivotal closure gate is moved against a closure spring as the movable wall is reciprocated.

It is a primary object of the present invention to provide a dispenser with a roller advancing means that is easy to use and simple to manufacture.

DESCRIPTION OF THE INVENTION

Figure 3:
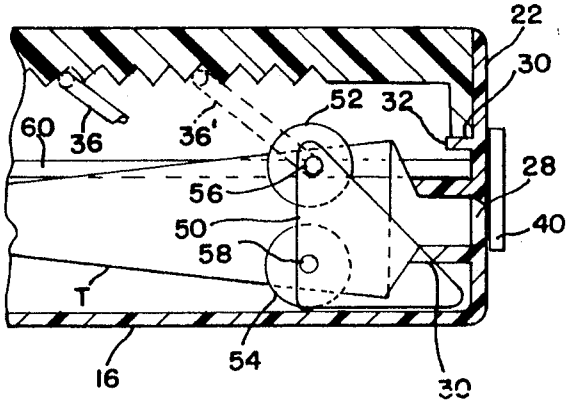
FIG. 3 is a side fragmental cross section view taken along the line 3—3 of FIG. 1.

Referring to the drawings there is shown in FIGS. 1–4 a dispenser 10 having a housing 12 and a mechanical follower 14 for squeezing paste from a tube T. Housing 12 has a bottom wall 16, a pair of opposed walls 18 and 20, and end walls 22 and 24. Each of the opposed end walls 18 and 20 has a guide rail 60. The use of the guide rail 60 will be explained in detail. End wall 22 has an aperture 28 and a tube dispensing conduit 30, which extends into the housing 12.

Housing 12 has an open top in which a reciprocating cover 32 slides. Reciprocating wall 32 may be spring biased to retain it in housing 12; however, the preferred situation is where the housing 12 is horizontal at all times and wall 32 moves freely in the housing. The bottom side of reciprocating wall 32 has a gear tooth 34 which engages a spring biased bar 36 of the mechanical follower system 14.

Figure 4:
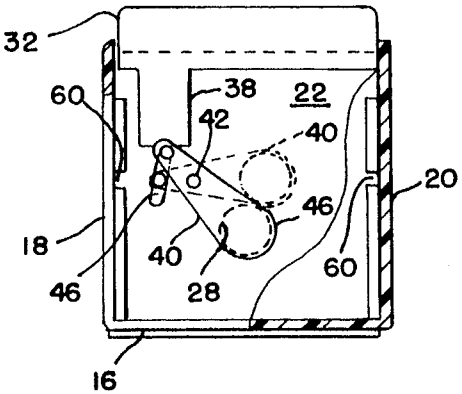
FIG. 4 is an end view of a paste dispenser of the invention, and a partial cross section taken along the line 4—4 of FIG. 1.
Figure 2:
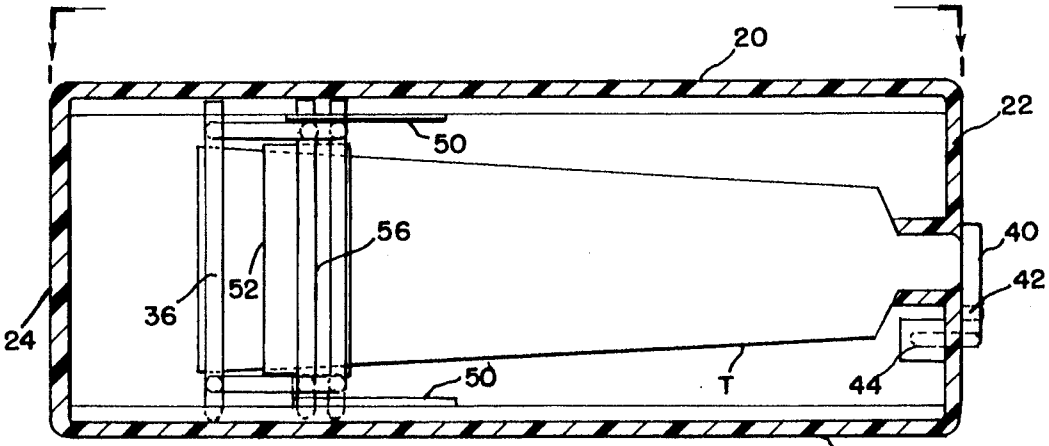
FIG. 2 is a top cross view of a paste dispenser taken along 2—2 of FIG. 1.
Figure 1:
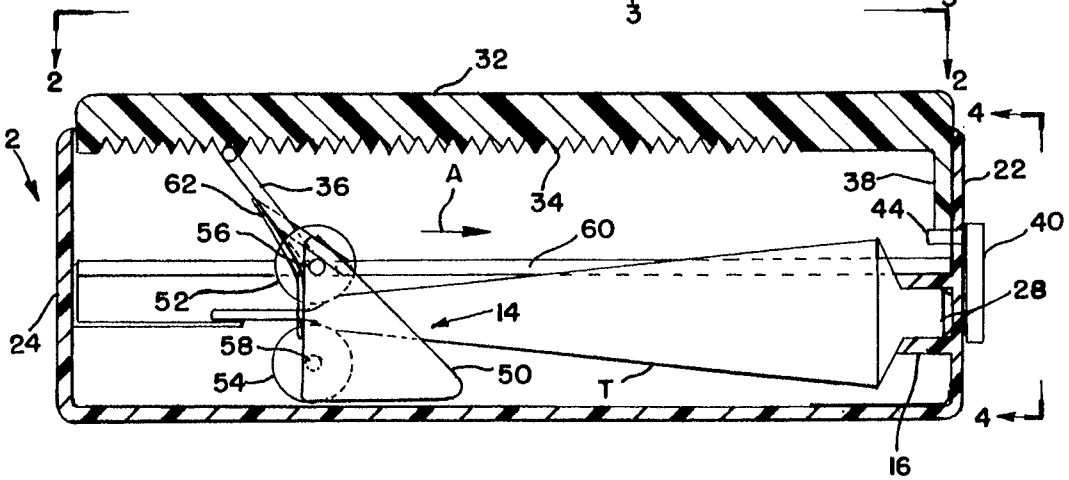
FIG. 1 is a side cross section view of a paste dispenser taken along the line 1—1 of FIG. 2.

A projection 38 extends downwardly from one end of reciprocating wall 32 to actuate a pivotal closure 40. FIG. 4 shows the closure 40 covering aperture 28 in the end wall 22. Closure 40 is pivotally mounted at 42 and has an arm 44 which extends through a slot 46 where it is in contact with projection 38. As reciprocating wall 32 is pushed downward, projection 38 actuates closure 40 by pushing down on arm 44 to pivot about point 42 opening aperture 28, as shown by phantom line 40'. The weight of closure 40 on end 46 returns the closure to the closed position.

Mechanical follower 14 includes a pair of sleds 50, and a pair of rollers 52 and 54 connected to the sleds 50 by axels 56 and 58, respectively. Axel 56 extends beyond sleds 50 to ride in a pair of guide rails 60 in walls 18 and 20 of housing 12. Rollers 52 and 54 are separated about the thickness of a collapsed tube T. Also mounted on the sleds 50 is a U-shaped pivotal bar 36 which contacts teeth 34 of reciprocating wall 32. U-shaped pivotal bar 36 is spring pressured by leaf spring 62 into teeth 34 whereby downward pressure on reciprocating wall 32 pushes down on bar 36 to move the mechanical follower 14 in the direction of arrow A. Upward pressure exerted on U-shaped pivotal bar 36 by leaf spring 62 moves wall 32 upward and at the same time advances the bar 36 along tooth gear 34 as shown in FIG. 3. Bar 36 is shown in a first position and a second position 36'.

In use, the reciprocating wall 32 is removed and the mechanical follower system 14 is retracted. A tube of paste, such as toothpaste, is placed in housing 12 with its cap removed and the open end placed in dispensing conduit 30. The other end of tube T is positioned between rollers 56 and 58. Reciprocating wall 32 is inserted in housing 12 where U-shaped pivotal bar 36 engages tooth gear 34. When the reciprocating wall 32 is pushed down, closure 40 opens and the mechanical follower 14 is moved forward. Each time reciprocating wall 32 is pushed down, the mechanical follower is moved forward engaging different teeth of tooth gear 34, until all of the paste has been dispensed.

While one embodiment of the invention has been shown, it is understood that those skilled in the art may realize other embodiments. Therefore, to understand the invention, the drawings, description and claims should be studied.

I claim:

1. A dispenser for dispensing paste from a collapsible tube, comprising;

a housing having a bottom wall, a pair of side walls and first end wall and a second end wall;

said pair of side walls having guide rail means;

said first end wall having a dispensing aperture means and a movable closure means;

a reciprocating top wall means having a toothed gear means on one side, and where said reciprocating top wall moves up and down in said housing; and a mechanical follower means including a pair of slidable support means, a pair of roller means mounted between said pair of slidable support means on axle means, where one of said roller means being above said other roller means to provide a space between said roller means to collapse a collapsible tube, and a pivotal bar means on said pair of slidable support means to engage said tooth gear means of said reciprocating wall to advance said mechanical follower means along a collapsible tube with each reciprocation of said reciprocating wall, said reciprocating wall having a projection means to engage and open said movable closure means on said first end wall, said movable closure means being pivotally mounted on said first end wall covering said dispensing aperture means, and an arm means on said movable closure extending through a slot in said first wall to contact said projection means on said reciprocating wall.

2. A dispenser as in claim 1 wherein one of said axle means rides in said guide rail means in said pair of side walls.

3. A dispenser as in claim 1 wherein said pivotal bar means on said pair of slidable support means being spring biased to engage said tooth gear means, whereby said pivotal bar advances said mechanical follower means when said reciprocating wall is pressed downward, as said reciprocating wall moves upward said pivotal bar advances along said tooth gear means to engage said tooth gear at an advanced position.

* * * * *